US010315871B2

(12) United States Patent
Tanaka

(10) Patent No.: US 10,315,871 B2
(45) Date of Patent: Jun. 11, 2019

(54) IMAGE FORMING APPARATUS

(71) Applicant: FUJI XEROX CO., LTD., Tokyo (JP)

(72) Inventor: Daisuke Tanaka, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/699,111

(22) Filed: Sep. 8, 2017

(65) Prior Publication Data

US 2018/0201457 A1 Jul. 19, 2018

(30) Foreign Application Priority Data

Jan. 17, 2017 (JP) ..... 2017-005585

(51) Int. Cl.

| | |
|---|---|
| ***B65H 3/52*** | (2006.01) |
| ***G03G 15/01*** | (2006.01) |
| ***B41J 2/01*** | (2006.01) |
| ***B65H 3/06*** | (2006.01) |
| ***B65H 5/06*** | (2006.01) |
| ***B41J 2/13*** | (2006.01) |

(52) U.S. Cl.

CPC ..... *B65H 3/5261* (2013.01); *B41J 2/01* (2013.01); *B41J 2/13* (2013.01); *B65H 3/0684* (2013.01); *B65H 5/062* (2013.01); *B65H 5/068* (2013.01); *G03G 15/0136* (2013.01); *B41J 2002/012* (2013.01); *B65H 2403/732* (2013.01); *B65H 2513/108* (2013.01)

(58) Field of Classification Search

USPC ..... 399/301

See application file for complete search history.

(56) References Cited

U.S. PATENT DOCUMENTS

| | | | | |
|---|---|---|---|---|
| 5,963,769 | A * | 10/1999 | Emukai | G03G 15/161 399/297 |
| 2005/0135844 | A1* | 6/2005 | Takenouchi | G03G 15/0131 399/297 |
| 2014/0147145 | A1* | 5/2014 | Yoshioka | G03G 15/1675 399/66 |
| 2014/0294411 | A1* | 10/2014 | Yoshioka | G03G 15/1695 399/45 |
| 2015/0277297 | A1 | 10/2015 | Fujisawa et al. | |

FOREIGN PATENT DOCUMENTS

| | | |
|---|---|---|
| JP | 2009-009103 A | 1/2009 |
| JP | 2015-194657 A | 11/2015 |

* cited by examiner

*Primary Examiner* — Shelby L Fidler
(74) *Attorney, Agent, or Firm* — Sughrue Mion, PLLC

(57) ABSTRACT

An image forming apparatus includes image forming units forming images, a movable body moving along a path extending in a direction in which the image forming units are arranged while the images are sequentially formed on the movable body or on a recording material transported by the movable body so as to be superposed with one another, a contact and separation unit moving to a contact position at which the contact and separation unit is in contact with the movable body and to a separation position at which the contact and separation unit is separated from the movable body and changing a load applied to the moving movable body as a position of the contact and separation unit is changed, and a change unit changing the load in a manner opposite to a change in the load upon a change in the position of the contact and separation unit.

13 Claims, 10 Drawing Sheets

IMAGE FORMING APPARATUS

CROSS-REFERENCE TO RELATED APPLICATIONS

This application is based on and claims priority under 35 USC 119 from Japanese Patent Application No. 2017-005585 filed Jan. 17, 2017.

BACKGROUND (i) Technical Field

The present invention relates to an image forming apparatus.

(ii) Related Art

When color registration is performed, a recording material goes to waste in order to determine whether misregistration between toner images of different colors has occurred on the recording material. In particular, in the case where a continuous sheet is used as a recording material, a large portion of the recording material will go to waste. Accordingly, in order to reduce the amount of waste produced when color registration is performed, it has been proposed to stop transportation of a recording material and perform color registration on an intermediate transfer body. However, when the transportation is stopped, a second transfer roller and the like are separated from the intermediate transfer body, and thus, there is a change in the load applied to the moving intermediate transfer body. As a result, the movement speed of the intermediate transfer body changes between when image formation in which a recording material is transported is performed and when color registration in which transportation of a recording material is stopped is performed, and there is a possibility that misregistration will occur when image formation is performed.

In an image forming apparatus that employs a tandem system and directly transfers toner images onto a recording material, it has been proposed to separate a transfer roller of an image engine corresponding to a color that will not be used from a recording material or a transport belt when changing the number of colors to be used. However, similar to the above, there is a possibility that the movement speed of a recording material or the like will change between when the transfer roller is in contact with the recording material or the like and when the transfer roller is separated from the recording material or the like, which in turn results in misregistration.

In other words, in the case where an image forming apparatus in which images are formed and sequentially transferred onto a movable body in such a manner as to be superposed with one another by plural image forming units includes a contact and separation unit that comes into and out of contact with the movable body, there is a possibility of misregistration. Although an image forming apparatus that employs an electrophotographic system has been described above as an example, there is a possibility of misregistration also in an image forming apparatus that employs, for example, an ink-jet system when the image forming apparatus includes a contact and separation unit.

SUMMARY

According to an aspect of the invention, there is provided an image forming apparatus including plural image forming units each of which forms an image, a movable body that moves along a movement path extending in a direction in which the plural image forming units are arranged while the images formed by the image forming units are sequentially formed on a surface of the movable body or on a surface of a recording material transported by the movable body in such a manner as to be superposed with one another, a contact and separation unit that is caused to move to a contact position at which the contact and separation unit is in contact with the movable body and to a separation position at which the contact and separation unit is separated from the movable body and that changes a load applied to the movable body, which moves, as a position of the contact and separation unit is changed, and a change unit that changes the load applied to the movable body in a manner opposite to a change in the load upon a change in the position of the contact and separation unit.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings.

Figure 1:
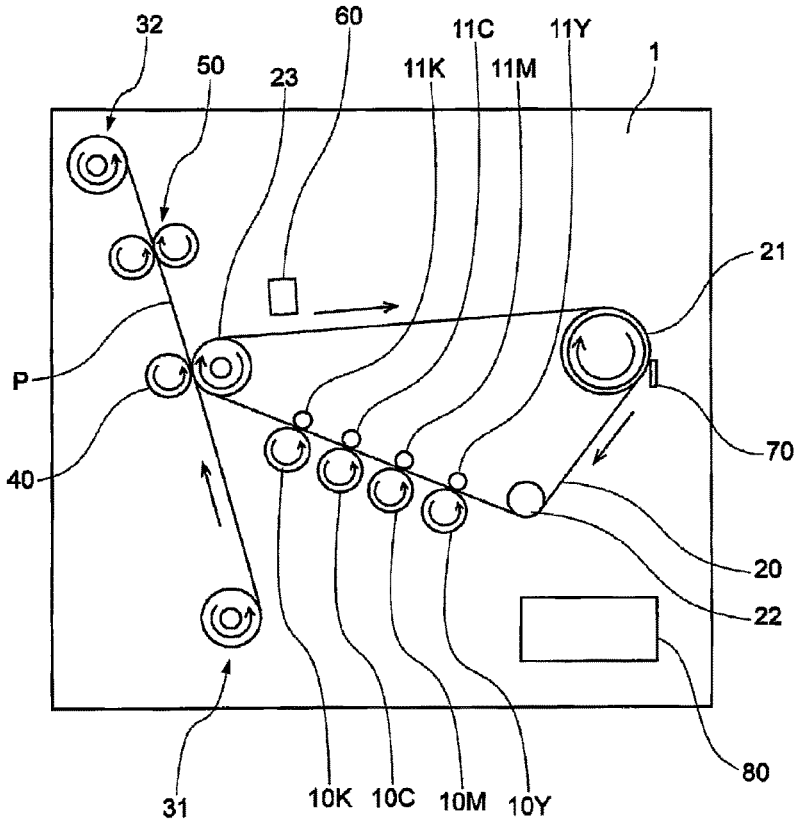
FIG. 1 is a schematic diagram illustrating an image forming apparatus according to a first exemplary embodiment of the present invention.

FIG. 1 is a schematic diagram illustrating an image forming apparatus according to a first exemplary embodiment. Note that FIG. 1 is a conceptual diagram illustrating the configuration of the image forming apparatus, and the arrangement in FIG. 1 may sometimes be different from a specific arrangement in the actual apparatus. Arrows in FIG. 1 indicate the movement directions of the corresponding components.

An image forming apparatus 1 illustrated in FIG. 1 is a color printer that employs a so-called tandem system. In the image forming apparatus 1, for example, a continuous sheet (roll sheet) P is used as a recording material. The continuous sheet P is rolled and wound around a feeding unit 31, and the feeding unit 31 sends out the continuous sheet P. A portion of the continuous sheet P on which an image has been formed is rolled up by a winding unit 32.

The image forming apparatus 1 includes four image engines that correspond to four colors of, for example, yellow (Y), magenta (M), cyan (C), and black (K). In the first exemplary embodiment, each of the image engines employs a so-called electrophotographic system and forms a toner image.

In FIG. 1, the image engines are represented by photoconductor drums 10Y, 10M, 10C, and 10K that are incorporated in the image engines. In the image engines, toner images of the different colors are formed on the photoconductor drums 10Y, 10M, 10C, and 10K by performing charging, light exposure, and development.

The image forming apparatus 1 includes an intermediate transfer belt 20. The intermediate transfer belt 20 is stretched by a driving roller 21, a driven roller 22, and a backup roller 23 and caused to move along a circular path that extends above the image engines by a driving force of the driving roller 21. The driven roller 22 rotates and is driven by the moving intermediate transfer belt 20. The intermediate transfer belt 20 corresponds to an example of a movable body according to the present invention.

First transfer rollers 11Y, 11M, 11C, and 11K are disposed at positions facing the photoconductor drums 10Y, 10M, 10C, and 10K of the image engines with the intermediate transfer belt 20 interposed between the first transfer rollers 11Y, 11M, 11C, and 11K and the photoconductor drums 10Y, 10M, 10C, and 10K. Toner images of the different colors formed on the photoconductor drums 10Y, 10M, 10C, and 10K are sequentially transferred onto the intermediate transfer belt 20 in such a manner as to be superposed with one another by the first transfer rollers 11Y, 11M, 11C, and 11K. As a result of such transfer of the toner images, a color image is formed on the intermediate transfer belt 20. A combination of each of the image engines and a corresponding one of the first transfer rollers corresponds to an example of an image forming unit according to the present invention. In the first exemplary embodiment, an image forming operation is performed on the intermediate transfer belt 20, which is an example of the movable body, by transferring images from the photoconductor drums 10Y, 10M, 10C, and 10K onto the intermediate transfer belt 20.

The above-mentioned continuous sheet P is pressed against a surface of the intermediate transfer belt 20 by a second transfer roller 40 that faces the backup roller 23. The second transfer roller 40 transfers a color image formed on the intermediate transfer belt 20 onto the continuous sheet P. In addition, the second transfer roller 40 has contact and separation functions, which are to move toward and away from the intermediate transfer belt 20. In the first exemplary embodiment, although the contact and separation functions are realized by a cam mechanism, a stepping motor, and the like, which are not illustrated, the contact and separation functions may be realized by a different mechanism that is commonly known.

When the second transfer roller 40 moves to a transfer position that is illustrated in FIG. 1 by using the contact and separation functions, the continuous sheet P is pressed against the intermediate transfer belt 20 by the second transfer roller 40. When the second transfer roller 40 moves to a retreat position that is spaced apart from the intermediate transfer belt 20, the continuous sheet P also separates from the intermediate transfer belt 20. A combination of the second transfer roller 40 and the continuous sheet P corresponds to an example of a contact and separation unit according to the present invention. The state illustrated in FIG. 1 corresponds to a state where the contact and separation unit according to the present invention is located at a contact position. A state where the second transfer roller 40 has moved to the retreat position as described above corresponds to a state where the contact and separation unit according to the present invention is located at a separation position.

The image forming apparatus 1 includes a fixing unit 50, and a color image that has been transferred to the continuous sheet P by the second transfer roller 40 is fixed onto the continuous sheet P as a result of being heated and pressurized by the fixing unit 50.

The image forming apparatus 1 includes an image sensor 60 that detects a color image on the intermediate transfer belt 20, a cleaner 70 that scrapes off unwanted substances such as residual toner and paper dust from the intermediate transfer belt 20 by using a blade, and a controller 80 that controls each unit in the image forming apparatus 1.

The image forming apparatus 1 has a function that is so-called color registration and adjusts the timing at which toner images are formed by the image engines such that the toner images are transferred onto the intermediate transfer belt 20 in such a manner as to be superposed with one another without misregistration. More specifically, toner images for use in color registration are formed by the image engines, and the image sensor 60 detects the positions of the toner images on the intermediate transfer belt 20 so as to determine misregistration between the toner images. Then, the controller 80 adjusts the timing at which the image engines form toner images in such a manner that misregistration is reduced.

In the image forming apparatus 1 according to the first exemplary embodiment, when color registration is performed, the second transfer roller 40 and the continuous sheet P are separated from the intermediate transfer belt 20, and transportation of the continuous sheet P is stopped. Consequently, no portions of the continuous sheet P will go to waste when color registration is performed. When image formation is performed on the continuous sheet P after color registration has been completed, the continuous sheet P is pressed against the intermediate transfer belt 20 by the second transfer roller 40.

In general, when there is an object that comes into and out of contact with the intermediate transfer belt 20 as described above, there is a change in the load applied to the intermediate transfer belt 20, which moves, between when the object is in contact with the intermediate transfer belt 20 and when the object is separated from the intermediate transfer belt 20, and there is a possibility that the movement speed of the intermediate transfer belt 20 will also change. Such a change in the movement speed causes misregistration when images are formed on the continuous sheet P. Therefore, the image forming apparatus 1 according to the first exemplary embodiment is provided with a speed maintaining function for suppressing changes in the movement speed so as to avoid misregistration. The speed maintaining function will be described in detail below.

Figure 2:
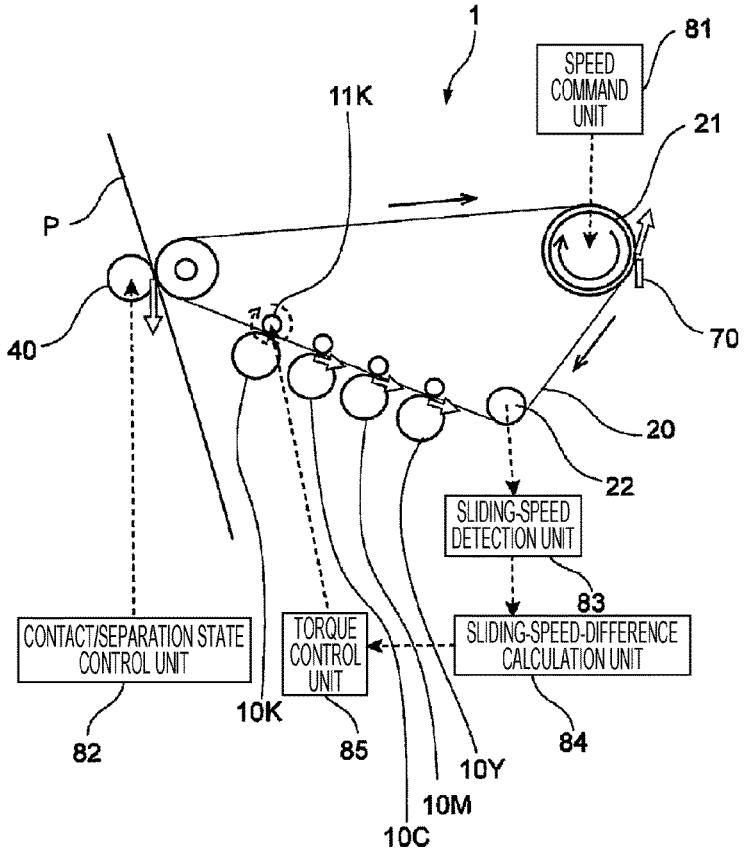
FIG. 2 is a schematic diagram illustrating a speed maintaining function in a state where a second transfer roller is located at an image-formation position.
Figure 3:
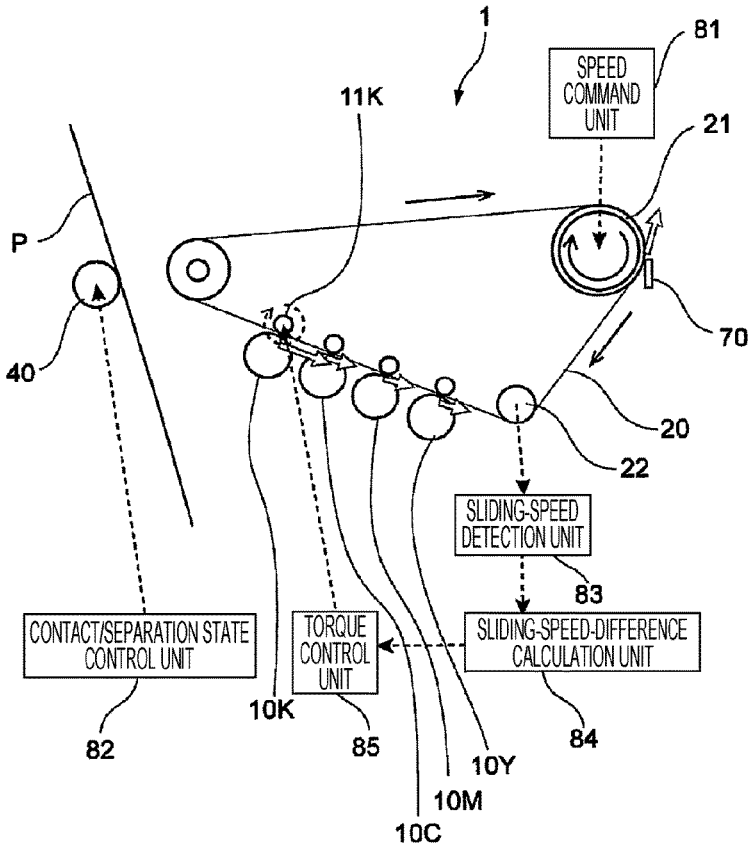
FIG. 3 is a schematic diagram illustrating the speed maintaining function in a state where the second transfer roller is located at a retreat position.

FIG. 2 and FIG. 3 are schematic diagrams each illustrating the speed maintaining function. FIG. 2 illustrates a state in which the second transfer roller 40 is located at an image-formation position, and FIG. 3 illustrates a state in which the second transfer roller 40 is located at the retreat position.

In the first exemplary embodiment, the driving roller 21 is driven by a motor shared by the photoconductor drums 10Y, 10M, 10C, and 10K of the image engines and the like, and the speed at which the driving roller 21 rotates is kept constant by a speed command unit 81. The function of the speed command unit 81 is controlled by the controller 80 illustrated in FIG. 1. As described above, although the speed at which the driving roller 21 rotates is kept constant, a load is applied by the cleaner 70 and the photoconductor drums 10Y, 10M, 10C, and 10K to the intermediate transfer belt 20, which moves. This load is represented by outlined arrows in FIG. 2 and FIG. 3. The load causes the intermediate transfer belt 20 to slide over the driving roller 21, and there is a speed difference between the driving roller 21 and the intermediate transfer belt 20. In the image forming apparatus 1 according to the first exemplary embodiment, in order to detect the actual movement speed of the intermediate transfer belt 20, the speed at which the driven roller 22, which is driven by the intermediate transfer belt 20, rotates is detected by a sliding-speed detection unit 83 and converted into the movement speed of the intermediate transfer belt 20. The function of the sliding-speed detection unit 83 is also controlled by the controller 80 illustrated in FIG. 1.

As described above, the second transfer roller 40 is caused to move toward and away from the intermediate transfer belt 20 by the cam mechanism and the like. The movement of the second transfer roller 40 toward and away from the intermediate transfer belt 20 is controlled by a contact/separation state control unit 82, and the function of the contact/separation state control unit 82 is also controlled by the controller 80 illustrated in FIG. 1.

When an image is formed on the continuous sheet P, as described above, the second transfer roller 40 moves toward the intermediate transfer belt 20, and the continuous sheet P is pressed against the surface of the intermediate transfer belt 20. As a result of the second transfer roller 40 pressing the continuous sheet P against the surface of the intermediate transfer belt 20, there is a change in the load applied to the intermediate transfer belt 20, which moves. In the first exemplary embodiment, the change in the load is an increase in the load. The sliding-speed detection unit 83 detects the movement speed of the intermediate transfer belt 20 by taking into consideration the influence of the second transfer roller 40.

In the first exemplary embodiment, a case has been described in which the second transfer roller 40 applies a load to the intermediate transfer belt 20, which moves. However, if the second transfer roller 40 employs a driving system specific to the second transfer roller 40, there is a case where the second transfer roller 40 assists the intermediate transfer belt 20 in moving. In this case, the load applied to the moving intermediate transfer belt 20 decreases due to the influence of the second transfer roller 40. Both in the case where the influence of the second transfer roller 40 increases the load and in the case where the influence of the second transfer roller 40 decreases in the load, the sliding-speed detection unit 83 is configured to detect the movement speed of the intermediate transfer belt 20 by taking into consideration the influence of the second transfer roller 40.

When the second transfer roller 40 is located at the image-formation position, since the continuous sheet P is interposed between the second transfer roller 40 and the intermediate transfer belt 20, the second transfer roller 40 is not directly in contact with the intermediate transfer belt 20. However, the second transfer roller 40 may also be considered to be indirectly in contact with the intermediate transfer belt 20 with the continuous sheet P interposed therebetween, and thus, a state where the second transfer roller 40 presses the continuous sheet P against the intermediate transfer belt 20 may sometimes be described below as "the second transfer roller 40 is in contact with the intermediate transfer belt 20".

The movement speed of the intermediate transfer belt 20 detected by the sliding-speed detection unit 83 is compared with a predetermined reference speed by a sliding-speed-difference calculation unit 84. As a result, the speed difference between the reference speed and the actual speed is calculated by the sliding-speed-difference calculation unit 84. The function of the sliding-speed-difference calculation unit 84 is also controlled by the controller 80 illustrated in FIG. 1.

In the first exemplary embodiment, the first transfer roller 11K that faces the photoconductor drum 10K, which is one of the four photoconductor drums 10Y, 10M, 10C, and 10K and which corresponds to color K, is independently driven by a motor different from the motor that drives the other first transfer rollers, the driving roller 21, and the like. As a result of a driving torque of the motor that drives the first transfer roller 11K for color K being increased and decreased by a torque control unit 85, the load applied to the intermediate transfer belt 20, which moves, is adjusted, and the movement speed of the intermediate transfer belt 20 is increased and decreased. The torque control unit 85 controls the driving torque so as to reduce the speed difference calculated by the sliding-speed-difference calculation unit 84 as much as possible. By performing this so-called feedback control, the movement speed of the intermediate transfer belt 20 precisely returns to the reference speed and becomes stable.

In a state where the driving torque applied to the first transfer roller 11K for color K is controlled in the manner described above, when the second transfer roller 40 moves to the retreat position and separates from the intermediate transfer belt 20 as illustrated in FIG. 3, the load applied to the intermediate transfer belt 20, which moves, changes. In the first exemplary embodiment, the load is reduced by an amount equal to the load generated by the second transfer roller 40 being in contact with the intermediate transfer belt 20. At the moment at which the load applied to the moving intermediate transfer belt 20 changes in this manner, the movement speed of the intermediate transfer belt 20 deviates from the reference speed. Such a deviation in speed is detected by the sliding-speed detection unit 83 and the sliding-speed-difference calculation unit 84, and the driving torque applied to the first transfer roller 11K for color K is controlled by the torque control unit 85 in such a manner that the deviation is reduced. This causes the movement speed of the intermediate transfer belt 20 to return to the reference speed again.

By controlling the driving torque in the manner described above, in the first exemplary embodiment, a load equivalent to the load reduced as a result of the second transfer roller 40 moving away from the intermediate transfer belt 20 is applied to the first transfer roller 11K for color K. Unlike the first exemplary embodiment, in the case where the second transfer roller 40 employs a driving system specific to the second transfer roller 40 and assists the intermediate transfer belt 20 in moving, the load applied to the moving intermediate transfer belt 20 increases as a result of the second transfer roller 40 moving away from the intermediate transfer belt 20. In this case, the first transfer roller 11K for color K is caused to assist the intermediate transfer belt 20 in moving by controlling the driving torque applied to the first transfer roller 11K for color K in such a manner that the load applied to the moving intermediate transfer belt 20 is reduced by an amount equal to the load increased.

In other words, the first transfer roller 11K for color K changes the load applied to the moving intermediate transfer belt 20 in a manner opposite to the change in the load upon separation of the second transfer roller 40 from the intermediate transfer belt 20, and the movement speed of the intermediate transfer belt 20 is maintained at the reference speed. The first transfer roller 11K for color K corresponds to an example of a change unit according to the present invention. In addition, the first transfer roller 11K for color K corresponds to an example of a second member according to the present invention and also corresponds to an example of a transfer member according to the present invention. That is to say, in the first exemplary embodiment, the first transfer roller 11K for color K is used both in transfer of a toner image and control of the load applied to the intermediate transfer belt 20, which moves, so as to make efficient use of the first transfer roller 11K. The torque applied to the first transfer roller 11K, which is a roll-shaped member, is stably controlled, and thus, the load applied to the intermediate transfer belt 20, which moves, is also stably adjusted.

Conversely, when the second transfer roller 40 moves from the retreat position to the image-formation position, and the load applied to the moving intermediate transfer belt 20 changes, the torque control unit 85 controls the driving torque such that the first transfer roller 11K for color K changes the load in a manner opposite to the change upon the movement of the second transfer roller 40 from the retreat position to the image-formation position. The driving torque is controlled in this manner, and as a result, the load applied to the intermediate transfer belt 20, which moves, is adjusted, so that the differences in the load applied to the moving intermediate transfer belt 20 and the movement speed of the intermediate transfer belt 20 between when the second transfer roller 40 is separated from the intermediate transfer belt 20 and when the second transfer roller 40 is in contact with the intermediate transfer belt 20 are reduced. Therefore, the probability of occurrence of misregistration is reduced even in the case where color registration is performed in the state illustrated in FIG. 3 in which the second transfer roller 40 is located at the retreat position, and then image formation is performed in the state illustrated in FIG. 2 in which the second transfer roller 40 has moved to the image-formation position.

Note that, in the above-described first exemplary embodiment, although a case has been described in which a continuous sheet is used as a recording material, also in the case where a cut sheet is used as a recording material, there has been proposed a configuration in which, when color registration is performed, the second transfer roller 40 is separated from the intermediate transfer belt 20 in order to avoid contamination of the second transfer roller 40, and the above-described speed maintaining function is effective for avoiding misregistration.

The other exemplary embodiments of the present invention will be described below.

A second exemplary embodiment is similar to the first exemplary embodiment, except with regard to a system for controlling the torque applied to the first transfer roller 11K for color K. The second exemplary embodiment will be described below focusing on the difference from the first exemplary embodiment.

Figure 4:
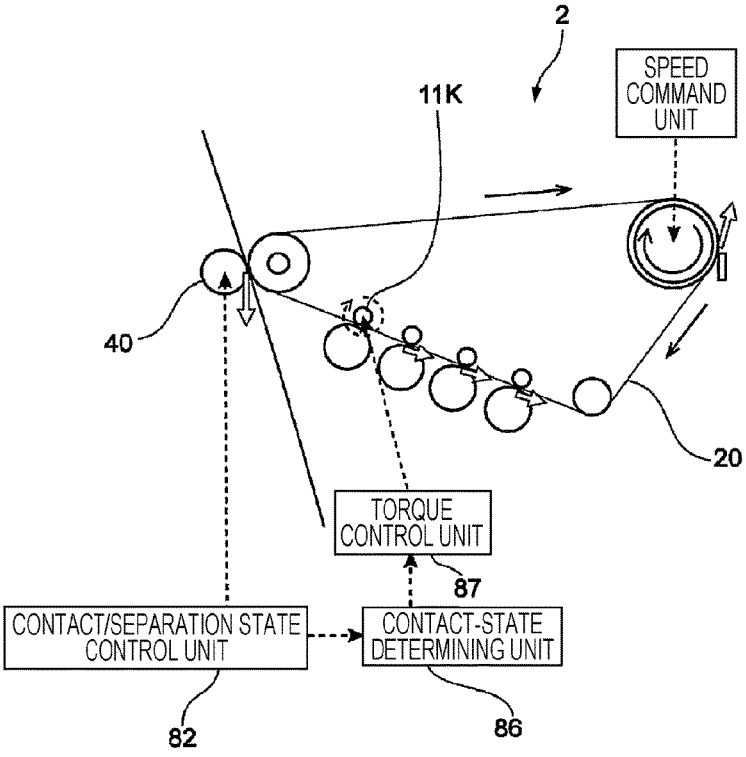
FIG. 4 is a diagram illustrating a state in which a second transfer roller according to a second exemplary embodiment of the present invention is located at the image-formation position.
Figure 5:
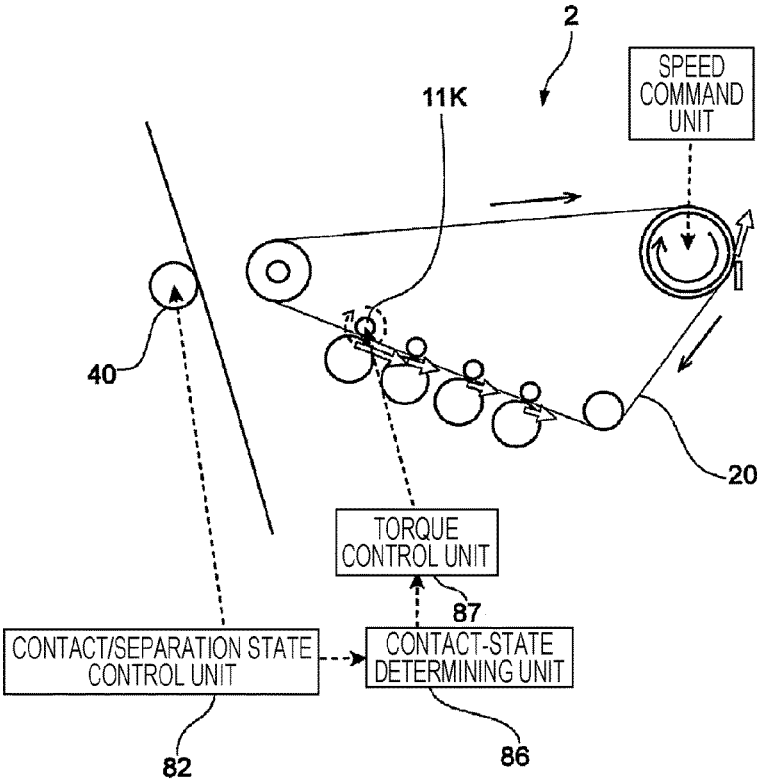
FIG. 5 is a diagram illustrating a state in which the second transfer roller according to the second exemplary embodiment is located at the retreat position.

FIG. 4 and FIG. 5 are diagrams each illustrating the second exemplary embodiment. FIG. 4 illustrates a state in which the second transfer roller 40 is located at the image-formation position, and FIG. 5 illustrates a state in which the second transfer roller 40 is located at the retreat position.

In an image forming apparatus 2 according to the second exemplary embodiment, as a method of controlling the torque applied to the first transfer roller 11K for color K, a simple switching control is employed instead of feedback control such as that employed in the first exemplary embodiment. In other words, the image forming apparatus 2 according to the second exemplary embodiment includes a contact-state determining unit 86 and a torque control unit 87, and the contact-state determining unit 86 obtains a control signal for the second transfer roller 40 transmitted by the contact/separation state control unit 82 and determines a contact state or a separation state of the second transfer roller 40. Then, in accordance with the contact state or the separation state determined by the contact-state determining unit 86, the torque control unit 87 sets one of two types of driving torques to the driving torque for the first transfer roller 11K for color K and controls the driving torque.

In the state illustrated in FIG. 4, the contact-state determining unit 86 determines that the second transfer roller 40 is in the contact state, and for example, the driving torque for the first transfer roller 11K for color K is controlled by the torque control unit 87 in such a manner that no torque is applied to the intermediate transfer belt 20 by the first transfer roller 11K for color K.

In the state illustrated in FIG. 5, the contact-state determining unit 86 determines that the second transfer roller 40 is in the separation state. Then, the driving torque applied to the first transfer roller 11K for color K is controlled by the torque control unit 87 in such a manner as to, for example, generate a load equal to the load applied to the intermediate transfer belt 20 by the second transfer roller 40 in the state illustrated in FIG. 4.

As a result of performing such switching control, also in the second exemplary embodiment, the first transfer roller 11K for color K changes the load applied to the intermediate transfer belt 20 in a manner opposite to the change in the load upon separation of the second transfer roller 40 from the intermediate transfer belt 20. Therefore, the difference in the load applied to the intermediate transfer belt 20, which moves, between when the second transfer roller 40 is in contact with the intermediate transfer belt 20 and when the second transfer roller 40 is separated from the intermediate transfer belt 20 is reduced as well as the difference in the movement speed.

Such simple switching control according to the second exemplary embodiment is simpler and easier to introduce than the feedback control according to the first exemplary embodiment.

A third exemplary embodiment will now be described. The third exemplary embodiment is similar to the first exemplary embodiment, except with regard to the type of the change unit according to the present invention. The third exemplary embodiment will be described below focusing on the difference from the first exemplary embodiment.

Figure 6:
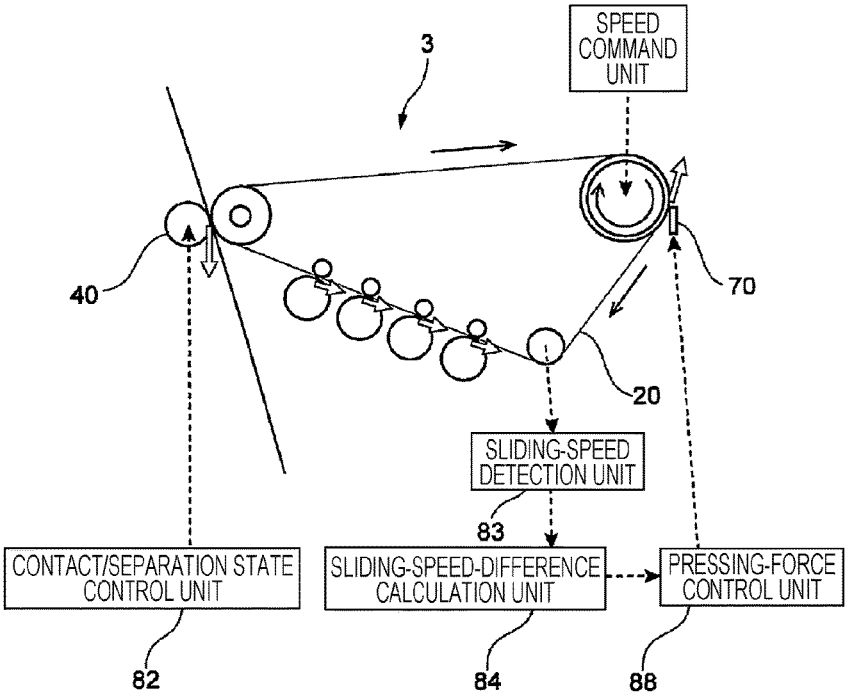
FIG. 6 is a diagram illustrating a state in which a second transfer roller according to a third exemplary embodiment of the present invention is located at the image-formation position.
Figure 7:
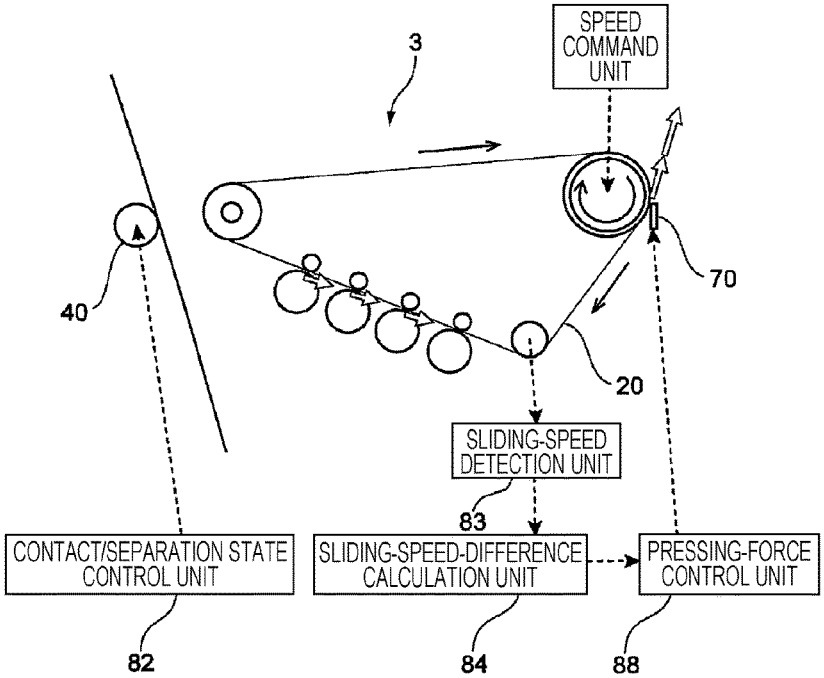
FIG. 7 is a diagram illustrating a state in which the second transfer roller according to the third exemplary embodiment is located at the retreat position.

FIG. 6 and FIG. 7 are diagrams each illustrating the third exemplary embodiment of the present invention. FIG. 6 illustrates a state in which the second transfer roller 40 is located at the image-formation position, and FIG. 7 illustrates a state in which the second transfer roller 40 is located at the retreat position.

In an image forming apparatus 3 according to the third exemplary embodiment, the cleaner 70 has a change function for changing a pressing force applied to the blade that is pressed against the intermediate transfer belt 20. In third exemplary embodiment, although this change function is realized by a cam mechanism, a stepping motor, and the like, which are not illustrated, the change function may be realized by a different mechanism that is commonly known. The cleaner 70 applies a load to the intermediate transfer belt 20, which moves, as a result of the blade and the intermediate transfer belt 20 rubbing against each other. When the pressing force applied to the blade is changed by the change function, the degree of rubbing between the blade and the intermediate transfer belt 20 is changed, and the load applied to the moving intermediate transfer belt 20 is also changed.

As a result of the pressing force applied to the blade, which is pressed against the intermediate transfer belt 20, being increased and decreased by a pressing-force control unit 88 using the change function, the load applied to the intermediate transfer belt 20, which moves, is adjusted, and the movement speed of the intermediate transfer belt 20 is increased and decreased. Adjusting the load applied to the moving intermediate transfer belt 20 by controlling the pressing force applied to the blade may accommodate a larger change in the load compared with the case of adjusting the load by, for example, performing torque control in the manner described in the first exemplary embodiment.

Similar to the first exemplary embodiment, the image forming apparatus 3 according to the third exemplary embodiment includes the sliding-speed detection unit 83 and the sliding-speed-difference calculation unit 84.

The pressing-force control unit 88 controls the pressing force so as to reduce the speed difference calculated by the sliding-speed-difference calculation unit 84 as much as possible. By performing such control, also in the third exemplary embodiment, the movement speed of the intermediate transfer belt 20 returns to the reference speed and becomes stable.

Also in the third exemplary embodiment, when the second transfer roller 40 moves from the image-formation position, which is illustrated in FIG. 6, to the retreat position, which is illustrated in FIG. 7, in a state where the pressing force applied to the blade is controlled in the manner described above, the load applied to the intermediate transfer belt 20, which moves, decreases. As a result, the movement speed of the intermediate transfer belt 20 temporarily deviates from the reference speed, and the deviation is detected by the sliding-speed detection unit 83 and the sliding-speed-difference calculation unit 84. Then, the pressing force applied to the blade is controlled by the pressing-force control unit 88 in such a manner that the deviation is reduced. This causes the movement speed of the intermediate transfer belt 20 to return to the reference speed again.

Also when the second transfer roller 40 moves from the retreat position, which is illustrated in FIG. 7, to the image-formation position, which is illustrated in FIG. 6, deviation of the movement speed of the intermediate transfer belt 20 from the reference speed is detected, and the pressing force applied to the blade is controlled, so that the movement speed of the intermediate transfer belt 20 returns to the reference speed again.

As a result of controlling the pressing force applied to the blade in the manner described above, the cleaner 70 changes the load applied to the intermediate transfer belt 20, which moves, in a manner opposite to the change in the load upon contact or separation of the second transfer roller 40 with or from the intermediate transfer belt 20. Accordingly, in the third exemplary embodiment, the cleaner 70 corresponds to an example of the change unit according to the present invention. In addition, the blade included in the cleaner 70 corresponds to an example of a first member according to the present invention and also corresponds to an example of a removal member according to the present invention. In other words, in the third exemplary embodiment, the cleaner 70 and the blade are used both in cleaning of the intermediate transfer belt 20 and control of the load applied to the intermediate transfer belt 20, which moves, so as to make efficient use of the cleaner 70 and the blade.

Note that, although the feedback control similar to that in the first exemplary embodiment has been described above as an example of the method for controlling the pressing force applied to the blade of the cleaner 70, switching control similar to that in the second exemplary embodiment may be employed as the method for controlling the pressing force.

A fourth exemplary embodiment will now be described. The fourth exemplary embodiment is similar to the first exemplary embodiment except that a dedicated component has a function of serving as the change unit according to the present invention. The fourth exemplary embodiment will be described below focusing on the difference from the first exemplary embodiment.

Figure 8:
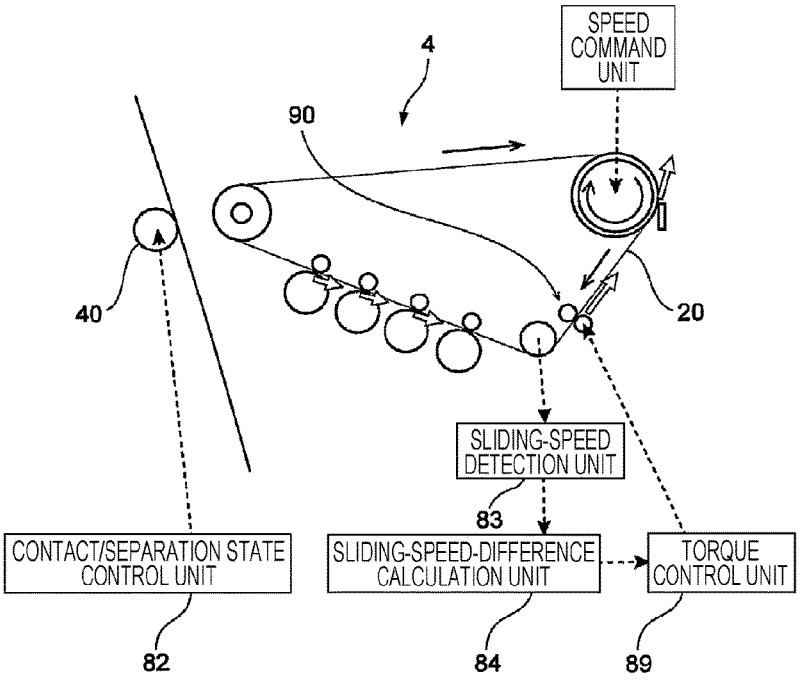
FIG. 8 is a diagram illustrating a fourth exemplary embodiment of the present invention.

FIG. 8 is a diagram illustrating the fourth exemplary embodiment of the present invention.

An image forming apparatus 4 according to the fourth exemplary embodiment includes a pair of rollers 90 that are driven by a drive motor specific to the pair of rollers 90 so as to rotate and that rotate with the intermediate transfer belt 20 interposed therebetween. A rotational-driving torque that is applied to the pair of rollers 90 is controlled by a torque control unit 89.

Similar to the first exemplary embodiment, the image forming apparatus 4 according to the fourth exemplary embodiment includes the sliding-speed detection unit 83 and the sliding-speed-difference calculation unit 84.

The torque control unit 89 controls the driving torque in a similar manner that the torque control unit 85 according to the first exemplary embodiment controls the driving torque. Thus, the pair of rollers 90 also change the load applied to the intermediate transfer belt 20, which moves, in a manner opposite to the change in the load upon contact or separation of the second transfer roller 40 with or from the intermediate transfer belt 20, and the movement speed of the intermediate transfer belt 20 returns to the reference speed whether or not the second transfer roller 40 is in contact with the intermediate transfer belt 20. In the fourth exemplary embodiment, the pair of rollers 90 correspond to an example of the change unit according to the present invention and are dedicated components for changing the load applied to the intermediate transfer belt 20, which moves. The pair of rollers 90 also correspond to an example of the second member according to the present invention. As described above, a dedicated component that functions as the change unit according to the present invention is provided, so that members that perform image transfer, belt cleaning, and the like do not need to change the load applied to the moving intermediate transfer belt 20. In the case where such members change the load applied to the moving intermediate transfer belt 20, this change operation may have an influence on their roles, which are image transfer and belt cleaning. However, since the members do not need to change the load applied to the moving intermediate transfer belt 20, image transfer and belt cleaning will not be influenced.

Note that, although the feedback control similar to that in the first exemplary embodiment has been described above as an example of the method for controlling the torque applied to the pair of rollers 90, switching control similar to that in the second exemplary embodiment may be employed as the method for controlling the torque. In addition, although the member that corresponds to an example of the second member according to the present invention has been described above as an example of the dedicated component that functions as the change unit according to the present invention, the member that corresponds to an example of the first member according to the present invention may be used as the dedicated component.

A fifth exemplary embodiment will now be described.

Figure 9:
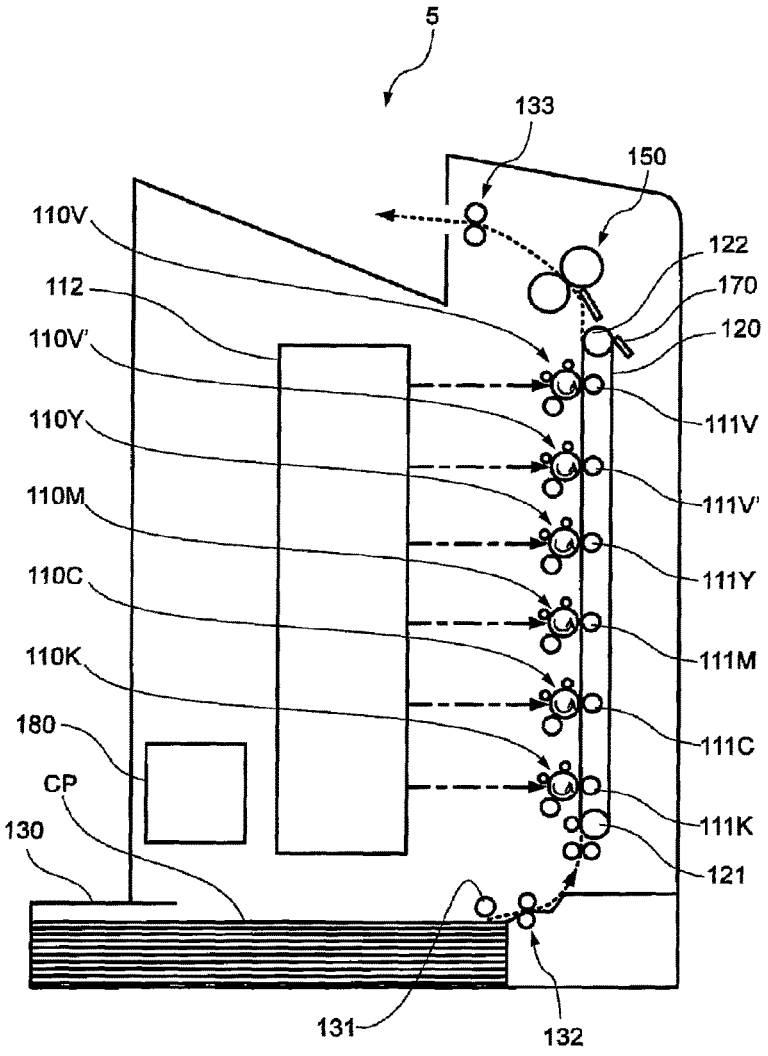
FIG. 9 is a diagram illustrating an image forming apparatus according to a fifth exemplary embodiment of the present invention.

FIG. 9 is a diagram illustrating an image forming apparatus according to the fifth exemplary embodiment of the present invention.

Although an image forming apparatus 5 according to the fifth exemplary embodiment is also a color printer that employs the tandem system, unlike the first exemplary embodiment, cut sheets CP are used as recording sheets. The cut sheets CP are stacked on top of one another in a sheet tray 130, which is disposed in a lower portion of the image forming apparatus 5, and are taken out one by one from the sheet tray 130 by a feed roller 131 and separation rollers 132.

The image forming apparatus 5 according to the fifth exemplary embodiment includes six image engines 110V, 110V', 110Y, 110M, 110C, and 110K that correspond to six colors including, for example, two spot colors and four colors of YMCK. Also in the fifth exemplary embodiment, each of the image engines 110V to 110K employs the electrophotographic system and forms a toner image. In the fifth exemplary embodiment, a single exposure unit 112 radiates exposure light beams onto the six image engines 110V to 110K.

The image forming apparatus 5 according to the fifth exemplary embodiment employs a direct transfer system and includes a sheet-transport belt 120. The sheet-transport belt 120 is stretched between a driving roller 121 and a driven roller 122 and caused to move along a circular path that extends in the direction in which the image engines 110V to 110K are arranged by a driving force of the driving roller 121. In the fifth exemplary embodiment, the sheet-transport belt 120 corresponds to an example of the movable body according to the present invention.

Transfer rollers 111V, 111V', 111Y, 111M, 111C, and 111K are disposed at positions facing the image engines 110V to 110K with the sheet-transport belt 120 interposed between the transfer rollers 111V to 111K and the image engines 110V to 110K. Each of the cut sheets CP is transported by the sheet-transport belt 120 so as to pass between the image engines 110V to 110K and the transfer rollers 111V to 111K. Toner images of different colors each of which is formed by a corresponding one of the image engines 110V to 110K are sequentially transferred onto one of the cut sheets CP in such a manner as to be superposed with one another by the transfer rollers 111V to 111K. As a result of such transfer of the toner images, a color image is formed on the cut sheet CP. A combination of each of the image engines and a corresponding one of the transfer rollers corresponds to an example of an image forming unit according to the present invention. In the fifth exemplary embodiment, image formation is directly performed on each of the cut sheets CP, which are examples of a recording material.

The image forming apparatus 5 includes a fixing unit 150, and a color image formed on one of the cut sheets CP is fixed onto the cut sheet CP as a result of being heated and pressurized by the fixing unit 150. The image forming apparatus 5 further includes a cleaner 170 that scrapes off unwanted substances, such as paper dust, from the sheet-transport belt 120 by using a blade and a controller 180 that controls each unit in the image forming apparatus 5.

The six image engines 110V to 110K included in the image forming apparatus 5 perform color image formation using, for example, four colors of CMYK in addition to color image formation using the six colors including the two spot colors.

In the case of performing such image formation using only four of the six colors, the image engines 110V and 110V' and the transfer rollers 111V and 111V' corresponding to the unnecessary colors are moved to retreat positions spaced apart from the sheet-transport belt 120 in order to avoid, for example, contamination and a reduction in the service life thereof. In the case of performing color image formation using the six colors, all the image engines and all the transfer rollers are moved to image-formation positions that are illustrated in FIG. 9.

As described above, in the fifth exemplary embodiment, the image engines 110V and 110V' and the transfer rollers 111V and 111V' each have contact and separation functions, which are to move into and out of contact with the sheet-transport belt 120. In the fifth exemplary embodiment, although the contact and separation functions are realized by a link mechanism, a cam mechanism, a stepping motor, and the like, which are not illustrated, the contact and separation functions may be realized by a different mechanism that is commonly known. A combination of each of the image engines 110V and 110V' and a corresponding one of the transfer rollers 111V and 111V' corresponds to an example of a contact and separation unit according to the present invention. The state illustrated in FIG. 9 corresponds to a state where the contact and separation units according to the present invention are located at contact positions. A state where the image engines 110V and 110V' and the like have moved to the retreat positions as described above corresponds to a state where the contact and separation units according to the present invention are located at separation positions.

The image forming apparatus 5 according to the fifth exemplary embodiment also has a color registration function and adjusts the timing at which toner images are formed by the image engines 110V to 110K such that the toner images are transferred onto one of the cut sheets CP in such a manner as to be superposed with one another without misregistration. More specifically, toner images for use in color registration are formed by the image engines 110V to 110K, and misregistration between the toner images on one of the cut sheets CP is, for example, measured or visually estimated. This misregistration is input to the controller 180, and the controller 180 adjusts the timing at which the image engines 110V to 110K form toner images in such a manner that the misregistration is reduced.

As described above, in the fifth exemplary embodiment, when the number of colors used in image formation is changed, the image engines 110V and 110V' and the transfer rollers 111V and 111V' come into or out of contact with the sheet-transport belt 120. In general, when there is an object that comes into and out of contact with the sheet-transport belt 120 as described above, there is a change in the load applied to the sheet-transport belt 120, which moves, between when the object is in contact with the sheet-transport belt 120 and when the object is separated from the sheet-transport belt 120, and there is a possibility that the movement speed of the sheet-transport belt 120 will also change. Such a change in the movement speed causes misregistration, and thus, also the image forming apparatus 5 according to the fifth exemplary embodiment is provided with a speed maintaining function for suppressing changes in the movement speed so as to avoid misregistration.

Figure 10:
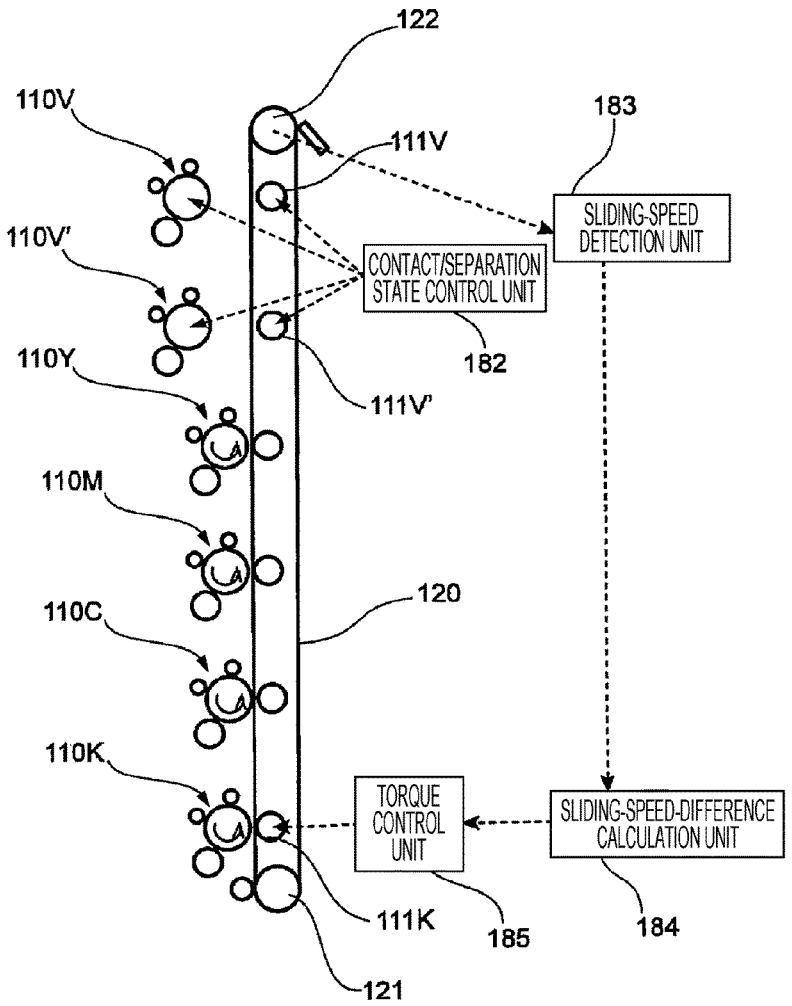
FIG. 10 is a diagram illustrating a speed maintaining function according to the fifth exemplary embodiment.

FIG. 10 is a diagram illustrating the speed maintaining function according to the fifth exemplary embodiment.

In the fifth exemplary embodiment, the driving roller 121 is driven by a motor shared by photoconductor drums included in the image engines 110V to 110K and the like, and the speed at which the driving roller 121 rotates is kept constant. However, a load is applied by the cleaner 170 and the like to the sheet-transport belt 120, which moves, and this load causes the sheet-transport belt 120 to slide over the driving roller 121. Consequently, there is a speed difference between the driving roller 121 and the sheet-transport belt 120.

Accordingly, in order to detect the actual movement speed of the sheet-transport belt 120, the speed at which the driven roller 122, which is driven by the sheet-transport belt 120, rotates is detected by a sliding-speed detection unit 183 and converted into the movement speed of the sheet-transport belt 120. The function of the sliding-speed detection unit 183 is controlled by the controller 180 illustrated in FIG. 9.

As described above, the image engines 110V and 110V' and the transfer rollers 111V and 111V' each have the contact and separation functions and moves into and out of contact with the sheet-transport belt 120. The movements of the image engines 110V and 110V' and the like into and out of contact with the sheet-transport belt 120 is controlled by a contact/separation state control unit 182, and the function of the contact/separation state control unit 182 is also controlled by the controller 180 illustrated in FIG. 9. The load applied by the image engines and the like to the sheet-transport belt 120, which moves, changes as a result of the image engines 110V and 110V' and the like moving into and out of contact with the sheet-transport belt 120, and the sliding-speed detection unit 183 detects the movement speed of the sheet-transport belt 120 by taking into consideration the influence of the change in the load.

The movement speed of the sheet-transport belt 120 detected by the sliding-speed detection unit 183 is compared with a predetermined reference speed by a sliding-speed-difference calculation unit 184. As a result, the speed difference between the reference speed and the actual speed is calculated by the sliding-speed-difference calculation unit 184. The function of the sliding-speed-difference calculation unit 184 is also controlled by the controller 180 illustrated in FIG. 9.

In the fifth exemplary embodiment, the transfer roller 111K that faces the image engine 110K, which is one of the six image engines 110V to 110K and which corresponds to color K, is independently driven by a motor different from the motor that drives the other transfer rollers, the driving roller 121, and the like. A driving torque of the motor that drives the image engine 110K for color K is controlled by a torque control unit 185. The torque control unit 185 controls the driving torque in a similar manner that the torque control unit 85 according to the first exemplary embodiment controls the driving torque, and the driving torque is increased and decreased in such a manner that the speed difference calculated by the sliding-speed-difference calculation unit 184 is reduced as much as possible, so that the load applied to the sheet-transport belt 120, which moves, is increased and decreased. As a result, the image engine 110K for color K changes the load applied to the sheet-transport belt 120 in a manner opposite to the change in the load upon contact or separation of the image engines 110V and 110V' and the transfer rollers 111V and 111V' with or from the sheet-transport belt 120, which moves, and the movement speed of the sheet-transport belt 120 returns to the reference speed and becomes stable. The image engine 110K for color K corresponds to an example of the change unit according to the present invention.

In the fifth exemplary embodiment, although the cut sheets CP are used as examples of a recording sheet in the image forming apparatus 5, which employs the direct transfer system, a continuous sheet may be used as a recording sheet also in the direct transfer system. In this case, the continuous sheet corresponds to an example of a movable body according to the present invention.

In addition, although the feedback control similar to that in the first exemplary embodiment has been described above as an example of the method for controlling the image engine 110K for color K, switching control similar to that in the second exemplary embodiment may be employed as the method for controlling the torque.

Although the image engine 110K for color K has been described as an example of the change unit according to the present invention, similar to the third exemplary embodiment, in the image forming apparatus 5, which employs the direct transfer system, the cleaner 170 may have a function of serving as the change unit according to the present invention. Alternatively, similar to the forth exemplary embodiment, a dedicated component that functions as the change unit according to the present invention may be provided.

In the above exemplary embodiments, although a combination of a second transfer roller and a continuous sheet and a combination of some image engines and some transfer rollers have been described as examples of the contact and separation unit according to the present invention, the contact and separation unit according to the present invention is not limited to these and may be any unit as long as the unit changes the load applied to the movable body according to the present invention, which moves, by coming into and out of contact with the movable body. In an indirect transfer system that uses an intermediate transfer body, similar to the fifth exemplary embodiment, there may be a case where some image engines each serve as the contact and separation unit. In addition, there may be a case where both a second transfer roller and an image engine serve as contact and separation units in a single image forming apparatus. In other words, plural contact and separation units according to the present invention may be provided in a single image forming apparatus.

In the above exemplary embodiments, although the units each employing an electrophotographic system have been described as examples of the image forming units according to the present invention, the image forming units according to the present invention may each employ an ink-jet system.

In the above exemplary embodiments, although a case has been described as an example in which movements of the contact and separation unit and the change unit according to the present invention into and out of contact with the movable body and the loads applied to the movable body by the contact and separation unit and the change unit are controlled by a control unit, the movements and the loads may be manually switched.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of image forming units each of which is configured to form an image;

a movable body configured to move in a movement direction along a movement path extending in a direction in which the plurality of image forming units are arranged while the images formed by the image forming units are sequentially formed on a surface of the movable body, or on a surface of a recording material transported by the movable body, in such a manner as to be superposed with one another;

a drive unit configured to drive the movable body;

a contact and separation unit configured to move to a contact position at which the contact and separation unit is in contact with the movable body and to a separation position at which the contact and separation unit is separated from the movable body, wherein the contact and separation unit is configured to change a load applied to the movable body, which moves, as a position of the contact and separation unit is changed; and a change unit configured to change the load applied to the movable body in a manner opposite to a change in the load upon a change in the position of the contact and separation unit, wherein the change unit is positioned between the driving unit and the contact and separation unit at a downstream side of the driving, unit in the movement direction.

2. The image forming apparatus according to claim 1, wherein the movable body is an intermediate transfer body onto which images are transferred from the plurality of image forming units, the images being to be further transferred onto the recording material.

3. The image forming apparatus according to claim 2, wherein the change unit is configured to change the load applied to the movable body, which moves, by changing a degree of rubbing between a first member and the movable body.

4. The image forming apparatus according to claim 3, wherein the first member is configured as a removal member configured to remove unwanted substances from the movable body by rubbing against the movable body.

5. The image forming apparatus according to claim 2, wherein the change unit is configured to change the load applied to the movable body, which moves, by changing a load applied to a second member that rotates while a peripheral surface of the second member is in contact with the surface of the movable body.

6. The image forming apparatus according to claim 5, wherein each of the plurality of image forming units includes:

an image carrier having a surface configured to have an image formed on the surface; and a transfer member that faces the image carrier and is configured to transfer an image from the image carrier onto the movable body by coming into contact with the movable body, and wherein the second member is configured as the transfer member included in at least one of the plurality of image forming units.

7. The image forming apparatus according to claim 1, wherein the change unit is configured to change the load applied to the movable body, which moves, by changing a degree of rubbing between a first member and the movable body.

8. The image forming apparatus according to claim 7, wherein the first member is configured as a removal member configured to remove unwanted substances from the movable body by rubbing against the movable body.

9. The image forming apparatus according to claim 1, wherein the change unit is configured to change the load applied to the movable body, which moves, by changing a load applied to a second member that rotates while a peripheral surface of the second member is in contact with the surface of the movable body.

10. The image forming apparatus according to claim 9, wherein each of the plurality of image forming units includes:

an image carrier having a surface configured to have an image formed on the surface; and a transfer member that faces the image carrier and is configured to transfer an image from the image carrier onto the movable body by coming into contact with the movable body, and wherein the second member is configured as the transfer member included in at least one of the plurality of image forming units.

11. The image forming apparatus according to claim 1, wherein the contact and separation unit is positioned downstream from the change unit in the movement direction.

12. The image forming apparatus according to claim 1, wherein the drive unit, the change unit and the contact and separation unit are positioned sequentially in the movement direction.

13. An image forming apparatus comprising:

a plurality of image forming units each of which is configured to form an image;

a movable body configured to move along a movement path extending in a direction in which the plurality of image forming units are arranged while the images formed by the image forming units are sequentially formed on a surface of the movable body, or on a surface of a recording material transported by the movable body, in such a manner as to be superposed with one another;

a contact and separation unit configured to move to a contact position at which the contact and separation unit is in contact with the movable body and to a separation position at which the contact and separation unit is separated from the movable body, wherein the contact and separation unit is configured to change a load applied to the movable body, which moves, as a position of the contact and separation unit is changed; and a change unit configured to change the load applied to the movable body in a manner opposite to a change in the load upon a change in the position of the contact and separation unit, wherein the change unit is configured to change the load applied to the movable body, which moves, by changing a load applied to a second member that rotates while a peripheral surface of the second member is in contact with the surface of the movable body, wherein each of the plurality of image forming units includes:

an image carrier having a surface configured to have an image formed on the surface; and a transfer member that faces the image carrier and is configured to transfer an image from the image carrier onto the movable body by coming into contact with the movable body, and wherein the second member is configured as the transfer member included in at least one of the plurality of image forming units.

* * * * *